US010207133B2

(12) United States Patent
Disimile

(10) Patent No.: US 10,207,133 B2
(45) Date of Patent: Feb. 19, 2019

(54) SMART NOZZLE DELIVERY SYSTEM

(71) Applicant: Peter Disimile, Cincinnati, OH (US)

(72) Inventor: Peter Disimile, Cincinnati, OH (US)

(73) Assignee: ESI Energy Solutions, LLC., Cincinnati, OH (US)

( * ) Notice: Subject to any disclaimer, the term of this patent is extended or adjusted under 35 U.S.C. 154(b) by 77 days.

(21) Appl. No.: 14/841,704

(22) Filed: Sep. 1, 2015

(65) Prior Publication Data

US 2016/0059057 A1 Mar. 3, 2016

Related U.S. Application Data

(60) Provisional application No. 62/044,364, filed on Sep. 1, 2014.

(51) Int. Cl.

| | |
|---|---|
| ***A62C 31/05*** | (2006.01) |
| ***A62C 3/08*** | (2006.01) |
| ***A62C 37/40*** | (2006.01) |

(52) U.S. Cl.

CPC ..... *A62C 3/08* (2013.01); *A62C 31/05* (2013.01); *A62C 37/40* (2013.01)

(58) Field of Classification Search

CPC ..... A62C 31/05; A62C 37/40; A62C 3/07; A62C 3/08; A62C 3/10; A62C 31/02; A62C 35/00; A62C 35/68; A62C 37/11; A62C 37/00; B05B 7/0408; B05B 7/0416; B05B 7/0861; B05B 12/14; B05B 7/0815; B05B 7/08; Y10T 137/87684; Y10T 137/87249; Y10T 137/87885

USPC .... 169/60, 46; 239/407, 418–426, 304, 306, 239/307, 400, 413–416.4

See application file for complete search history.

(56) References Cited

U.S. PATENT DOCUMENTS

| | | | | |
|---|---|---|---|---|
| 2,567,176 A | | 9/1951 | Ballard | |
| 2,726,897 A | | 12/1955 | Dupont | |
| 3,762,477 A | * | 10/1973 | Mobley, Sr. | A62C 37/00 169/14 |
| 3,866,687 A | | 2/1975 | Banner | |
| 4,671,362 A | | 6/1987 | Odashima | |
| 4,798,341 A | * | 1/1989 | Gimple | B05B 5/03 118/629 |
| 4,991,772 A | * | 2/1991 | Costa | B05B 7/0861 239/1 |

(Continued)

*Primary Examiner* — Alexander Valvis
*Assistant Examiner* — Juan C Barrera
(74) *Attorney, Agent, or Firm* — Michael C. Connelly

(57) ABSTRACT

A smart fluid application nozzle consisting of an optical based event locating system, a multi-port nozzle block, and a port switching mechanism is disclosed by the present application. The smart nozzle utilizes a unique arrangement of discharge ports, allowing the angle of the discharge agent to be controlled without moving the nozzle housing. Multiple ports are activated per event to create a uniform fluid distribution within the discharging jet while controlling the discharge angle, which cannot be achieved through a single port discharge. Upon receiving a detection signal, the event locating system determines the spatial location of the event region and activates the appropriate discharge ports, thereby directing agent toward the event zone and applying fluid while minimizing damage to nearby areas. The use of the system may be used wherever the precise directed application of as fluid is desired including, fire suppression.

13 Claims, 13 Drawing Sheets

(56) References Cited

U.S. PATENT DOCUMENTS

| | | | | | |
|---|---|---|---|---|---|
| 5,097,889 | A * | 3/1992 | Ritter | A62C 3/00 | 165/5 |
| 5,480,097 | A * | 1/1996 | Carter, Jr. | B22F 9/082 | 239/296 |
| 5,513,708 | A * | 5/1996 | Sundholm | A62C 37/08 | 169/37 |
| 5,548,276 | A | 8/1996 | Thomas | | |
| 5,571,562 | A * | 11/1996 | Wakat | B05B 7/066 | 118/315 |
| 5,839,667 | A | 11/1998 | Fishcer | | |
| 6,173,909 | B1 * | 1/2001 | Sprakel | A62C 31/02 | 239/444 |
| 8,520,929 | B1 * | 8/2013 | Murray | G06T 7/0004 | 156/64 |
| 8,960,318 | B2 | 2/2015 | Munroe | | |
| 2005/0011652 | A1 | 1/2005 | Hua | | |
| 2011/0017476 | A1 * | 1/2011 | Fuchs | A62C 3/002 | 169/11 |
| 2012/0186831 | A1 * | 7/2012 | Simpson | A62C 3/07 | 169/27 |

* cited by examiner

SMART NOZZLE DELIVERY SYSTEM

CROSS REFERENCE TO RELATED APPLICATIONS

This patent application claims the benefit of provisional patent application Ser. No. 62/044,364 filed Sep. 1, 2014 by the present applicant, the disclosure of which is hereby incorporated by reference in its entirety

BACKGROUND

Many applications exist which require a need to efficiently deliver a fluid to a local area of a surface, or region in space, that is selected at random. Yet, in most cases, this fluid is delivered by flooding the area, or region, of interest with the fluid and, thereby, eventually providing the required coverage. Unfortunately, this results in uneven levels of fluid deposition or concentration levels in some regions and insufficient deposition or concentration levels in others. This proves to be inefficient, wasteful, and in some applications, results in the unnecessary spread of dangerous or toxic products. Applications may simply involve the watering of grass and plants in a suburban home, spraying of deicing chemicals on the wings of aircraft at the local airport, insecticide spraying on a farm, the injection of fire suppressants in an attempt to extinguish a fire or the process of thermal cooling of electrical and electronic components to prevent overheating, such as those found in telecommunication and computer spaces.

Although there are some complicated mechanical mechanisms which may be capable of moving or articulating a fluid nozzle to an area of interest, these devices tend to be bulky and have many operational problems. Further, while these devices may possibly incorporate some limited feedback, there is no real time intelligence integrated into the device or the ability to evaluate the local conditions to ascertain when enough fluid has been delivered in real time. In some applications, the time response is critical to the effectiveness of the fluid delivery system.

The potential for accidental or intentional ignition in, or around, aircraft dry bays and engine nacelles remains a high-level threat to commercial and military aircraft survivability. Typical aircraft dry bays and engine nacelle regions contain critical components essential to the safe operation of the aircraft, such as hydraulic and fuel lines, avionics, and electrical wiring. The combination of these elements presents multiple possible fire scenarios, which fall into either accidental or intentional threats. For example, an intentional threat may consist of the rupture of a fuel tank from a ballistic impact causing a spray fire in an adjacent dry bay that critically damages the surrounding components. On the other hand, an accidental threat may consist of a fuel line leak within an engine nacelle, which ignites on the hot surface of the engine core. Fire protection within these vulnerable regions is, therefore, paramount due to the numerous fuel and ignition sources that are present. As a result of the inherently different fire scenarios, different suppression systems are often employed for each region, each of which requires a system capable of reacting effectively and efficiently to the presence of a fire. While passive technologies are often employed in dry bay protection systems, active halon suppression systems are often used in engine nacelle regions. In both scenarios, it has been determined that the overall protection benefit of increasing the effectiveness and efficiency of these systems far outweighs the cost of the system. The production ban on halogenated agents and the relative inefficiency of replacement agents further increases the need for a technology which can increase the overall system efficiency of both types of systems. Therefore, the need arises for a smart fluid delivery nozzle system which would increase the delivery mechanism of both active and passive fire protection systems, allowing not only the retrofit of current systems, but integration in the design of future systems as well.

For the past several decades, halogenated agents, notably halon 1301, have protected aircraft engine nacelles and some dry bays regions. Since the production ban on halon, scientists and engineers in the public and private sectors have been working on replacement agents and new technologies that attempt to achieve the efficiency of halon agents. For instance, innovative passive fire suppression technologies are being implemented into dry bay areas as an alternative to legacy halon systems, while the chemical industry is attempting to increase the efficiency of new halon replacement agents. Thus far, none of the systems or agents has succeeded completely in achieving the desired efficiency. All of the current technologies (passive or active) and new suppressants that have been deemed acceptable, when based on environmental friendliness, toxicity, materials compatibility, etc., lack fire-suppression efficiency as measured by weight and/or volume. To improve the fire-suppression efficiency of the candidate agents and technologies, one area of focus is suppressant distribution. For example, legacy halon 1301 systems were so effective (due to the supreme efficiency of halon 1301), research into understanding the suppressant delivery, especially in highly cluttered regions, offered little payoff. However, new replacement agents are less effective than halon 1301, making suppressant transport a more critical issue. Even the new innovative passive technologies are less effective compared to the legacy systems that they are attempting to replace. In fact, most suppression systems (active and passive) do not incorporate discharge nozzles at all, but rather simply dump suppressant in a very inefficient manner. With the lack of efficiencies in candidate technologies, increasing the agent delivery efficiency can have a large payoff in reducing the design time and/or weight of a fire protection system.

Over the last 10 years, the fire protection industry has been trying to move away from total flooding suppression systems toward systems with directed agent delivery as a method to increase system efficiency and reduce collateral damage. For instance, the US Navy has shifted from full-flooding systems for shipboard applications, to a highly directed water delivery system for their next generation fleet. These newer systems incorporate computer controlled telerobotic nozzles to direct agent at the fire region. This telerobotic nozzle technology is on the forefront of the fire protection industry. However, shipboard applications have minimal concerns with the weight of fire suppression systems. As such, such telerobotic nozzle systems are bulky and too heavy for consideration for aircraft platforms.

Aircraft platforms require fire protection systems optimized with minimal size and weight. For example, engine nacelle regions, which have the highest susceptibility to aircraft fires, contain a high level of clutter (fuel lines, wire bundles, etc.) within a compact space. This clutter blocks suppressant delivery and acts as a flame holder, protecting fires from suppression systems. As a result, a directed agent delivery would be preferred for this fire region, with the nozzles optimally placed to sufficiently protect the high risk regions. However, installation of the directed agent nozzles in an engine nacelle region is difficult due to the combination clutter in a confined space. As a result, suppression nozzles in engine nacelles will likely be installed between clutter elements to achieve the most efficient agent delivery. The proposed nozzle must not only be sufficiently small in size, but ideally would remain in a fixed position as to allow installation within the cluttered engine nacelle regions. By designing the proposed technology to meet the critical criteria necessary for engine nacelles, the nozzle will offer more than acceptable performance in dry bay areas which have increased size, less clutter and are less susceptible to fires.

Therefore, the need exists for a directional nozzle capable of being installed in both new and legacy aircraft fire suppression systems, which can automatically locate the fire region and discharge suppressant directly at the fire zone and not require total flooding of the region to be protected. This nozzle must be capable of installation in a tight space requirement, with minimal weight added, but also capable of protecting larger dry bay regions. Furthermore, this technology should not rely on a specific agent to achieve its effectiveness, since replacement systems use many separate agents. To this end, the current solution of a lightweight, self-contained universal "smart" fire suppression nozzle which is capable of locating a fire region (upon activation from an existing detector system) and discharging agent directly at the fire region within 100 ms, while remaining in a fixed installation position is presented.

SUMMARY

The proposed nozzle may be comprised of three primary components: an optical based event (such as fire or heat) locating system, a multi-port nozzle block, and a port switching mechanism. The smart nozzle utilizes a unique arrangement of discharge ports, which allows the angle of the discharge agent to be controlled (using jet to jet interactions) without moving the nozzle housing. Multiple ports will be activated per event to create a uniform agent distribution within the discharging jet while controlling the discharge angle, which may not be achievable through a single port discharge. The switching mechanism controls the flow from the agent supply to the discharge port block, while the optical event locating system determines the spatial location of the event region. Upon receiving a detection signal, the event locating system determines the spatial location of the event region and activates the appropriate discharge port or ports via the switching mechanism, thereby directing agent toward the event zone and, for example, extinguishing a fire or cooling a heated area, while minimizing damage to, or exposure by an agent to nearby areas. It is anticipated that a system equipped with the described smart multi-port nozzle may be used for a variety of non-fire suppression applications such as cooling, paint application, pesticide application, watering, coating, de-icing, steaming and heating or wherever the direct and discreet application of a fluid is required.

DRAWINGS—FIGURES

DRAWINGS—REFERENCE NUMERALS

Figure 1:
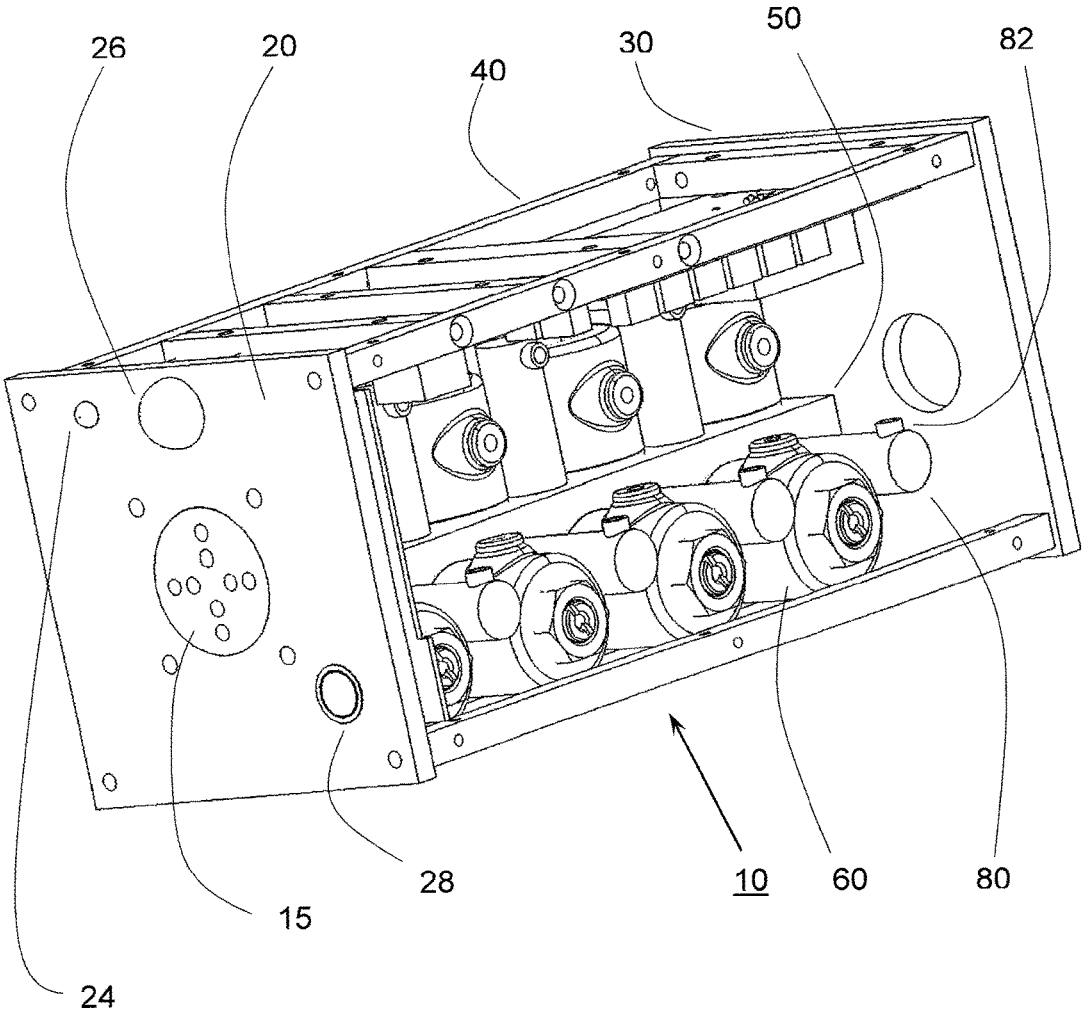
FIG. 1 is an overall front and side view without the outer casing of an embodiment of the fire suppression system of the present application.
Figure 2:
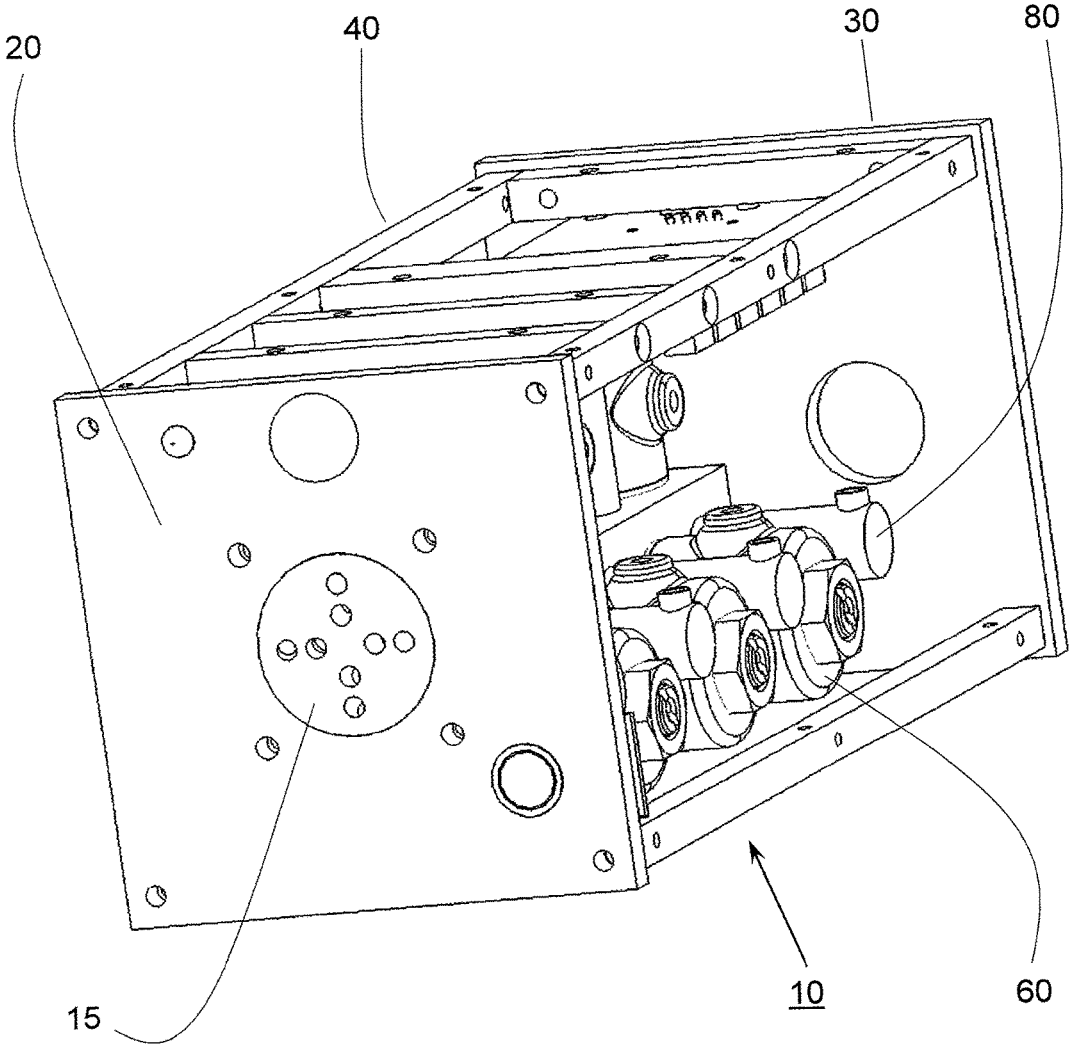
FIG. 2 is a further overall front and side view without the outer casing of an embodiment of the fire suppression system of the present application.
Figure 3:
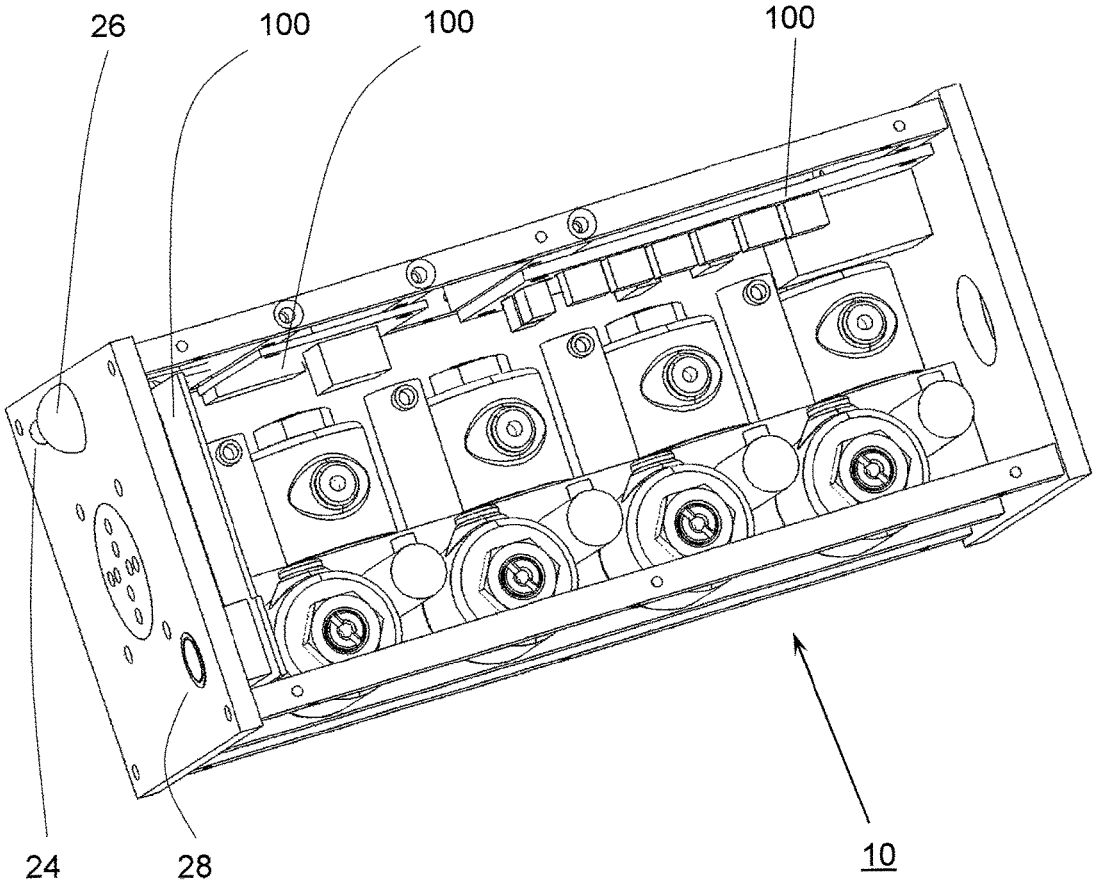
FIG. 3 is an overall side view without the outer casing of an embodiment of the fire suppression system of the present application.
Figure 4:
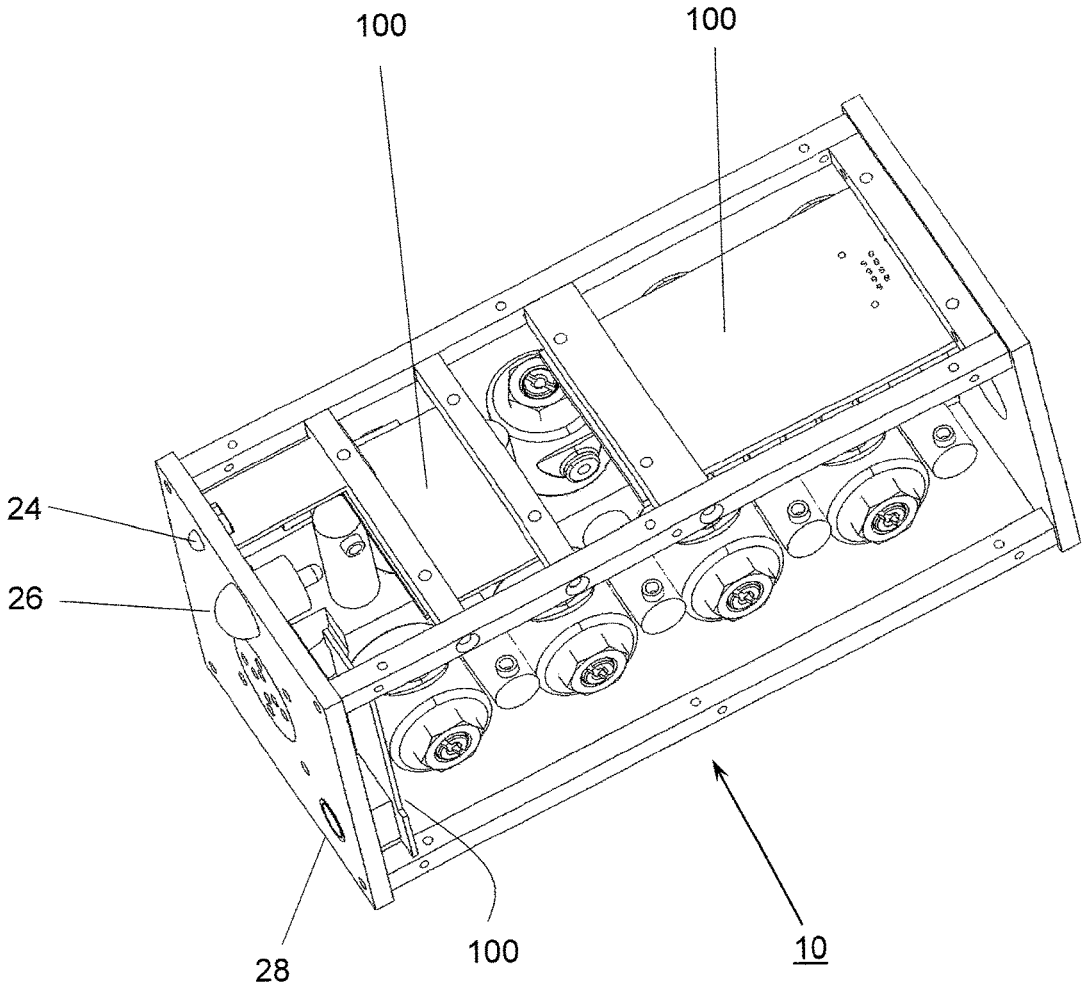
FIG. 4 is an overall top view without the outer casing of an embodiment of the fire suppression system of the present application.
Figure 5:
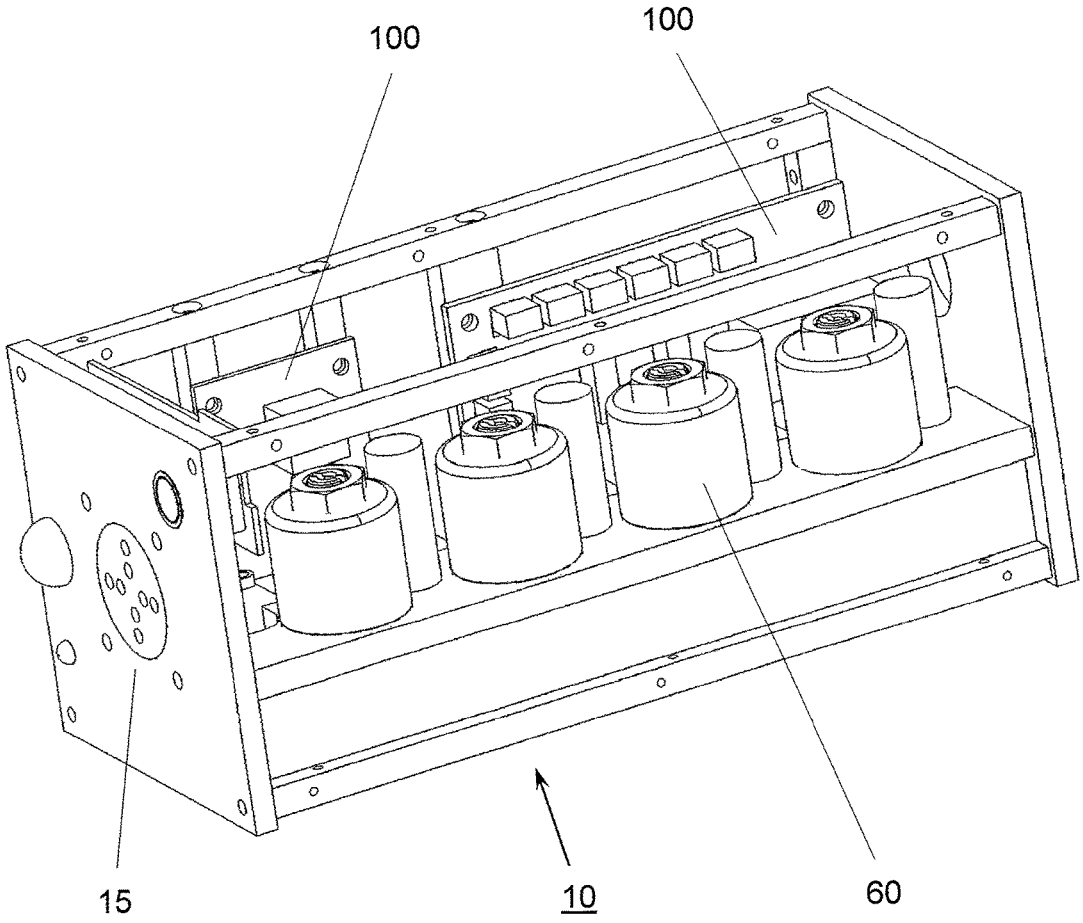
FIG. 5 is an overall bottom view without the outer casing of an embodiment of the fire suppression system of the present application.
Figure 6:
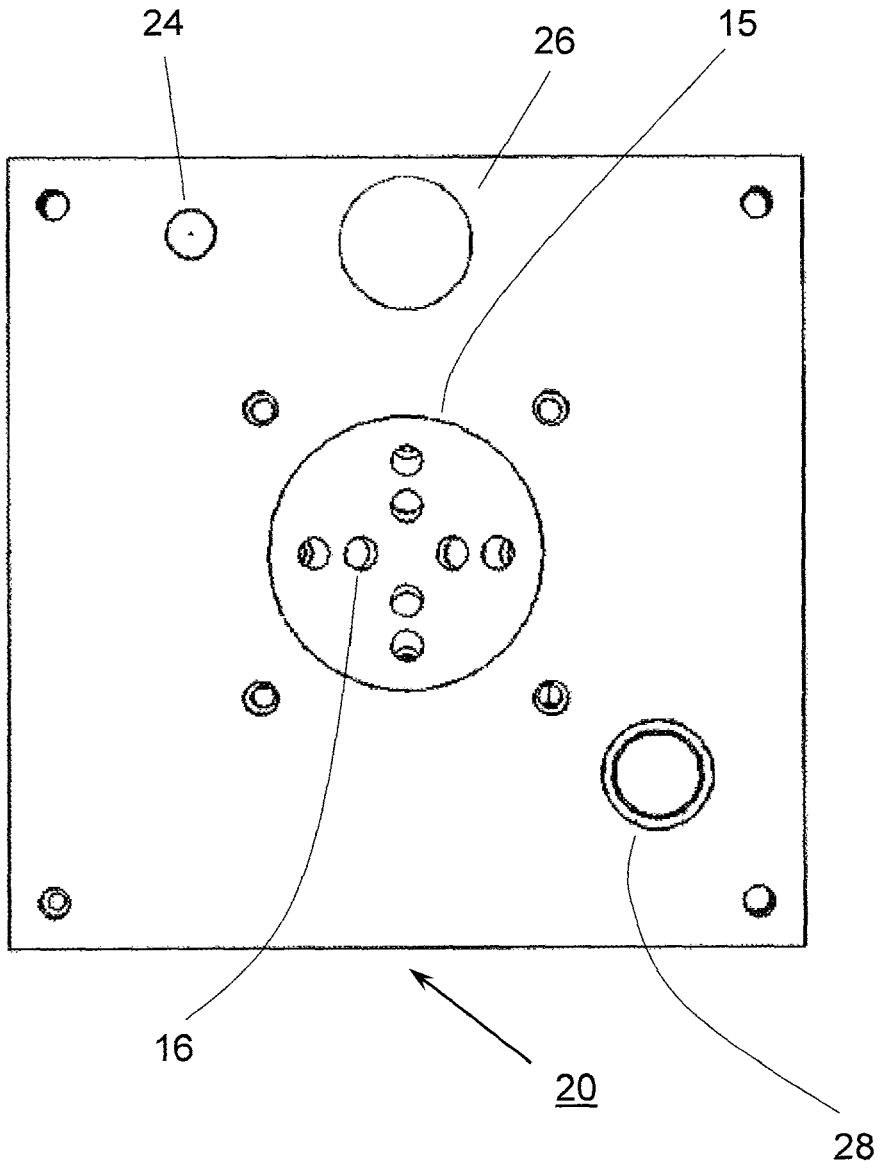
FIG. 6 is a front view of an embodiment of the fire suppression system of the present application.
Figure 7:
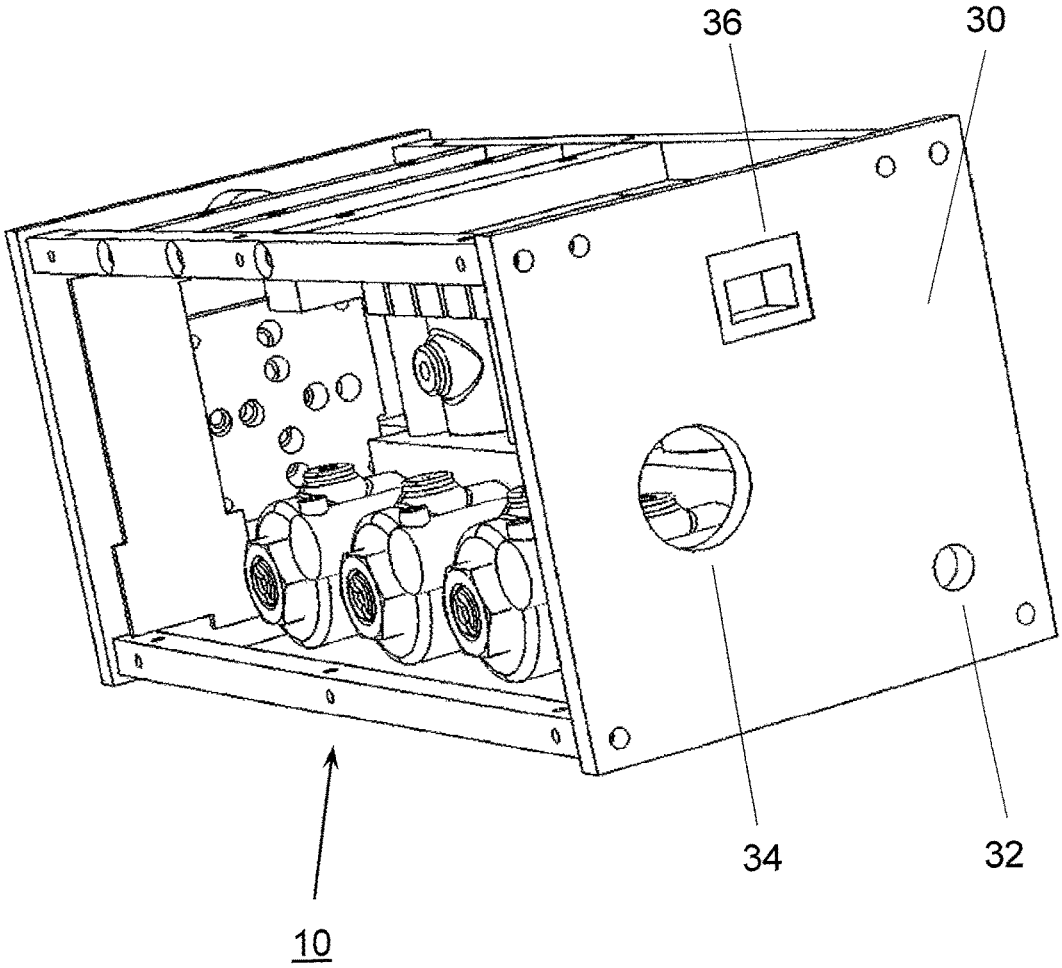
FIG. 7 is an overall rear view without the outer casing of an embodiment of the fire suppression system of the present application.
Figure 8:
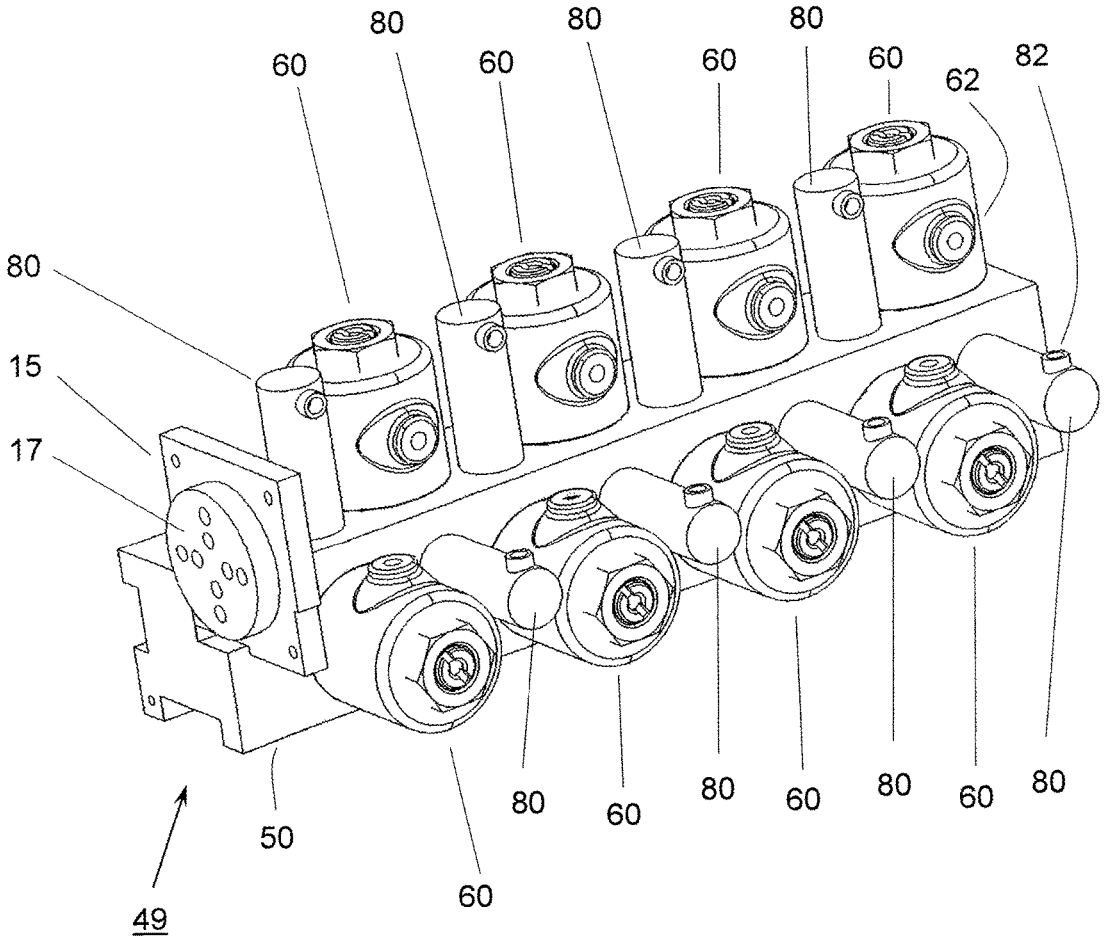
FIG. 8 is a view of the interior manifold, solenoids, nozzle and fluid reservoirs of an embodiment of the fire suppression system of the present application.
Figure 9:
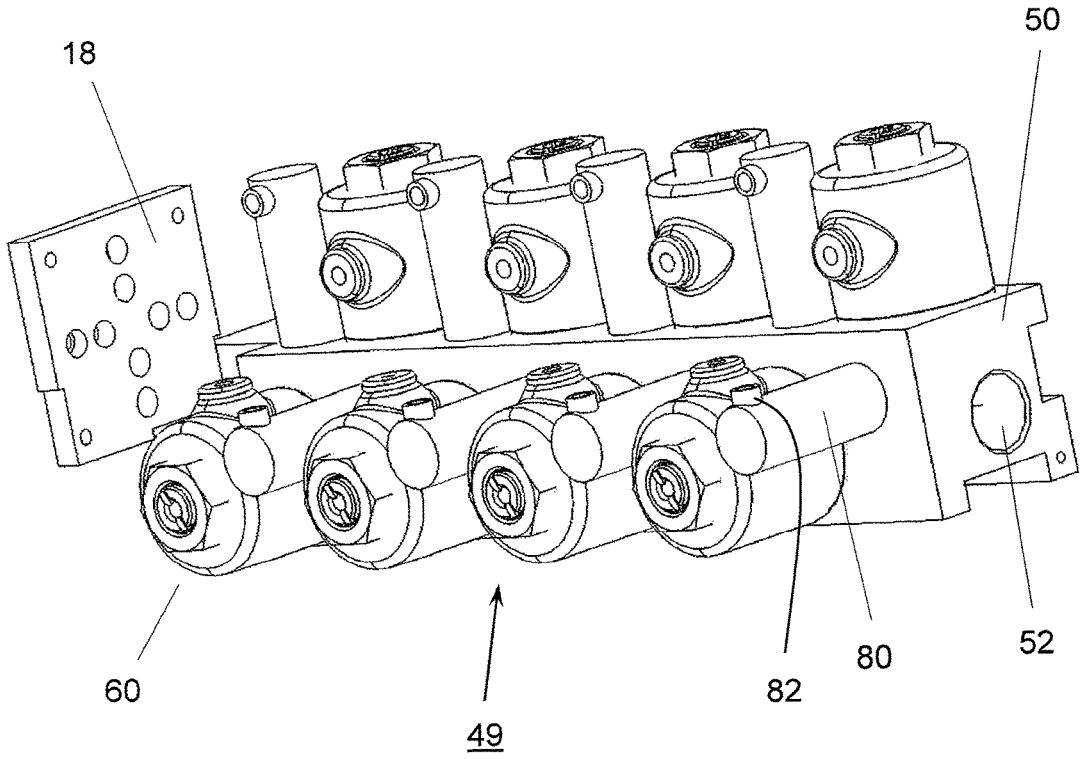
FIG. 9 is a further view of the interior manifold, solenoids, nozzle and fluid reservoirs of an embodiment of the fire suppression system of the present application.
Figure 10:
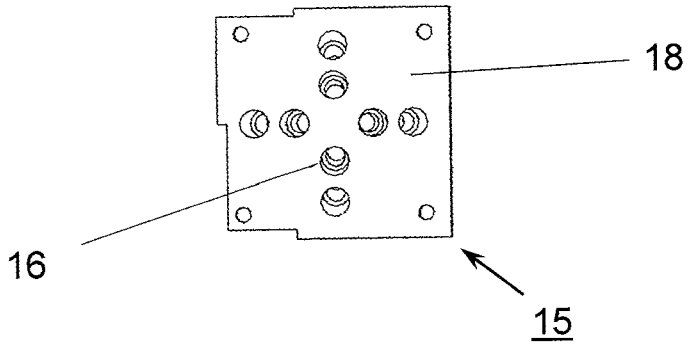
FIG. 10 is a front view of the nozzle of an embodiment of the fire suppression system of the present application.
Figure 11:
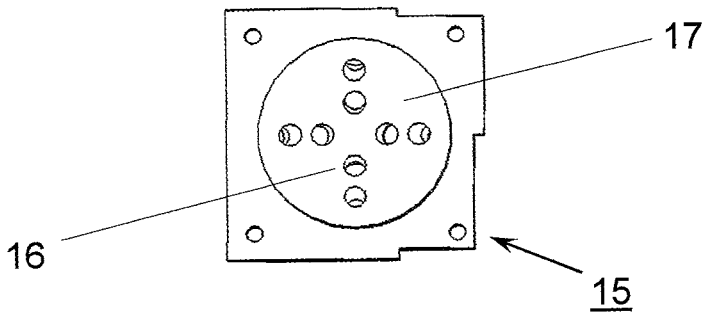
FIG. 11 is a rear view of the nozzle of an embodiment of the fire suppression system of the present application.
Figure 12:
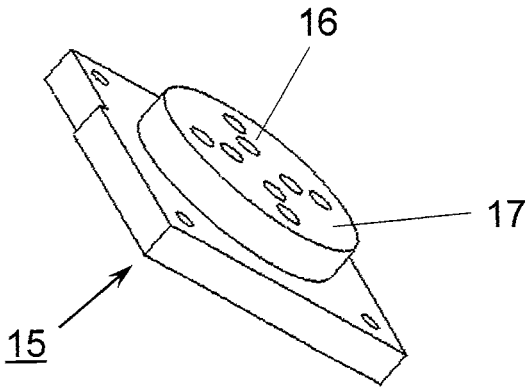
FIG. 12 is a rear view of the nozzle of an embodiment of the fire suppression system of the present application.
Figure 13:
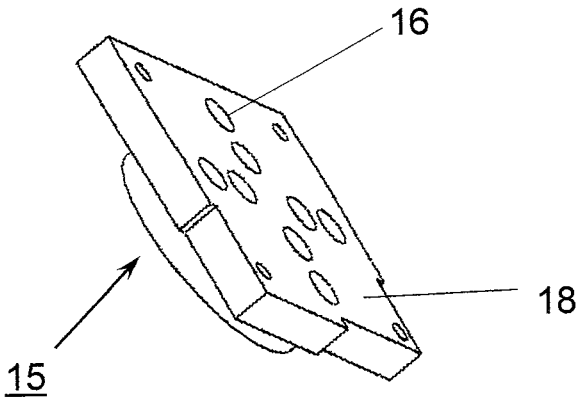
FIG. 13 is a front view of the nozzle of an embodiment of the fire suppression system of the present application.

| | | | |
|---|---|---|---|
| 10 | fire suppression system | 15 | nozzle block |
| 16 | agent port | 17 | outward nozzle face |
| 18 | inward nozzle face | 19 | port connector |
| 20 | front plate | 24 | IR sensor |
| 26 | UV sensor | 28 | camera |
| 30 | rear plate | 32 | pressure connection |
| 34 | electrical access | 36 | Ethernet hookup point |
| 40 | frame | 42 | casing |
| 49 | port switching assembly | 50 | manifold |
| 52 | manifold pressure inlet | 60 | solenoid |
| 62 | solenoid electrical input | 80 | agent cell |
| 82 | cell outlet | 100 | logic board |

DETAILED DESCRIPTION

Event Locating System

The event locating system (such as fire location) consists of hardware and software components, where the software component can be installed on a microchip or a desktop computer. In one embodiment, the hardware component consists of video cameras mounted directly to opposite sides of the nozzle housing. Two images, for example, of a dry bay or engine nacelle region will be acquired simultaneously. The cameras may be used in one of two modes; as a visible detector and as an IR detector. The type of camera/detector used is based on the phenomena or event to be monitored. If the application is one of thermal management, an IR sensitive camera/detector is anticipated. Therefore, as an area or component temperature increases beyond a prespecified level, cooling fluid would be applied directly to that component, and not the entire module. Such results in the area not being flooded with coolant and, thereby, a reduction in expended coolant and the energy savings of. In a fire protection scenario either, or, both the IR or the visible wavelength range would be used to determine the location of a fire. However, a visible camera would be more appropriate when the unit is being utilized for a coating application such as painting of a surface or spraying of insecticides. Non-fire suppression applications for the system are anticipated by the applicants as well. The use of one camera can provide 2D spatial information, and two or more cameras are used for 3D spatial positioning. Comparison between the two images will allow discrimination of the fire regions from ambient light, as well as heated sources, similar to advanced techniques employed for identification and characterization of forest fires.

The software (firmware) component controls image capture and pretreatment as well as fire verification and locating algorithms. This software may be based on the applicant's existing proprietary identification and tracking software and will only require slight modification for automation (removal of human interface). This machine vision type technique is similar to existing camera-based fire detection systems that are known in the art, with the added component of pinpointing the fire location. The software is written to enable consecutive images from the Visual/IR camera acquired, compared, and locate changes in the images. If no change is observed it continues the process. If a difference does exist, the software will determine where in the image this change has occurred. Then using a spatial calibration and triangulation scheme, the 2 or 3D location of the event is determined. Simultaneously, additional detectors (such as a UV detector), which have the ability to sense the event of interest, are positioned to have the same field of view. These additional sensors are selected specifically for the application. Only when the additional sensors confirm a particular event has occurred, is the camera spatial locating data transmitted to the discharging mechanism.

Fire Protection Example

Only when the two sensors (UV sensor and IR sensor focused on the same region) indicate the presence of a fire, is the spatial information taken from the camera and transmitted to the discharging mechanism, allowing for the discharge of fluid through the appropriate ports and thereby delivering fire suppressant to only that region. Verification of the fire region will be conducted via three steps. First, a periodically updated reference (no-fire) image will be stored for direct comparison of the fire images (acquired after detection signal). Secondly, cross-correlation techniques will be used to outline differences in the reference image and the image acquired during the fire event. This technique will be applied to the images acquired from both cameras. Lastly, second stage verification of a true fire region will be validated by comparison of the images.

With a fire region identified, the spatial location of the fire region will be determined using the applicant's proprietary software program. This software program was developed by the applicant to identify and track transient, high-speed events. Such software programs, computer languages and logic control systems are well known to those with knowledge in the art.

For a coating or de-icing process, such as an aircraft wing, sensors would inspect the wing for the presence of ice. Upon confirmation that the camera system has located an ice formation in space, the system delivers de-icing fluid to that location. As the ice moves or melts, that region would no longer receive de-icing fluid.

Discharging Fluid Control

The nozzle block consisting of an arrangement of multiple ports as shown in FIGS. 10-15 is made to impinge and redirect the resulting single or multiple phase (fluids can contain solid, liquid, and gas) jets. The actual number of ports, port spacing and relative angles of each port are determined for each application, however each port will be of sufficient size such that fouling or blockage is not a concern. The ports are oriented at different angles and can be fired independently or in multiples, but are generally positioned to face the area of interest. The size (length) and aperture of the ports are variable and are predetermined based on the location of the target and the amount of fluid that has to be delivered to the target zone. The nozzle block may be machined, three dimensionally printed or formed by other means. Due to the nature of this nozzle design, it is expected that an optimal discharge port size can be successfully determined to allow passage of all classes of fire suppressant agents, including but not limited to: Dupont FM-200 and FE-25, water, carbon dioxide, nitrogen, potassium bicarbonate, monoammonium phosphate, $CO_2$/potassium bicarbonate, and sodium bicarbonate. The nozzle block is attached to a manifold which is connected directly to the suppressant supply. Control of the suppressant discharged angle is achieved by opening and closing specific ports, allowing the jets to interact with each other or discharge singly and directly to the area of interest. This method of controlling the discharge jet angle through a multiple port discharge nozzle was successfully developed and demonstrated by the applicant during a previous research effort. The multi-port technology demonstrated during this previous research program only required a single discrete jet angle shift and therefore, multiple angles were not examined. However, the multiple port technology proposed for the current nozzle has been successfully demonstrated to be capable of directing the exiting agent jet, with a fixed nozzle housing position. Furthermore, since the $CO_2$/potassium bicarbonate agent utilized is a powder/gas mixture representing the largest size of most fire suppression agents, this nozzle can achieve similar success with other smaller sized agents. It is also important to note that the shift demonstrated utilizing the multiple port nozzles did not adversely affect the distribution in the discharged jet, which is not easily achieved using a single port discharge mechanism.

The switching mechanism may consist of an electromechanical valve arrangement for each discharge port. The valve can be operated in the on/off mode or as a proportional device where by the flow can be metered according to the need as provided by the sensing circuit. The valve may have a mechanism that controls the amount of fluid that can pass through the valve body and exit a specific discharge port. The amount of fluid to be discharged through the valve depends on the thermodynamic properties of the fluid, the pressure and temperature of the fluid upstream of the valve and the open area of the valve through which the fluid will pass. When the valve is operated in the isolation mode the valve can be either open or closed. When the valve is operated in the proportional mode the percentage of valve opening is controlled electronically or using a linear positioning device.

A method to locate a fire or other event followed by the direct and localized application of a fire suppressant or other fluid is anticipated. The apparatus and method of operation as described above is to be employed in the method. The method comprises the detection of a fire (or other event) with a camera, picking a nozzle port(s) to contact the correct specific spot with the aid of software and application of a fluid to the specific spot. The method may be fully or partially automated. The method is envisioned as being applicable to a wide variety of fluid applications for various purposes as described above.

Figure 14:
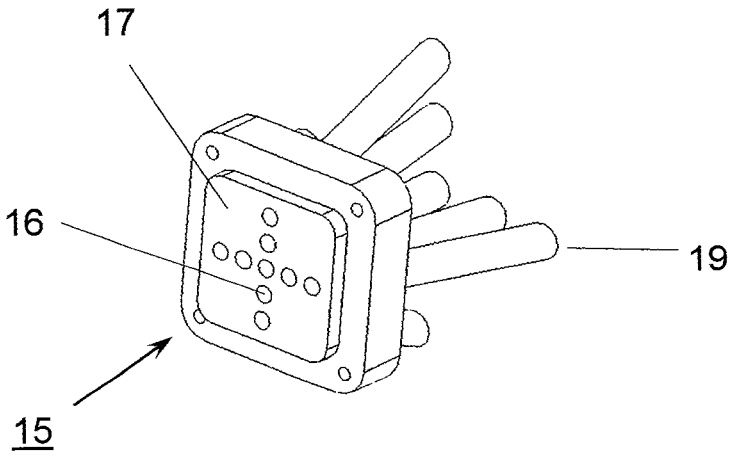
FIG. 14 is a front view of the nozzle with extensions of an embodiment of the fire suppression system of the present application.
Figure 15:
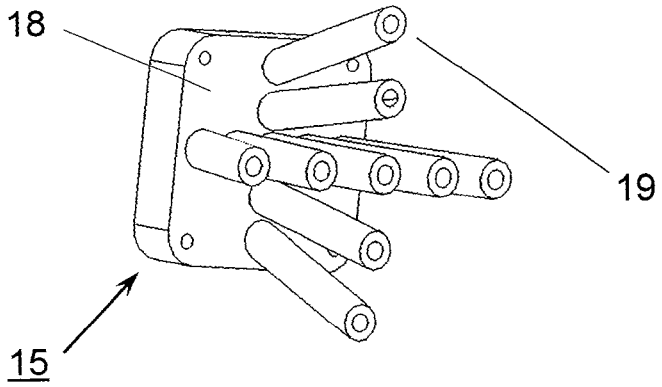
FIG. 15 is a rear view of the nozzle with extensions of an embodiment of the fire suppression system of the present application.
Figure 16:
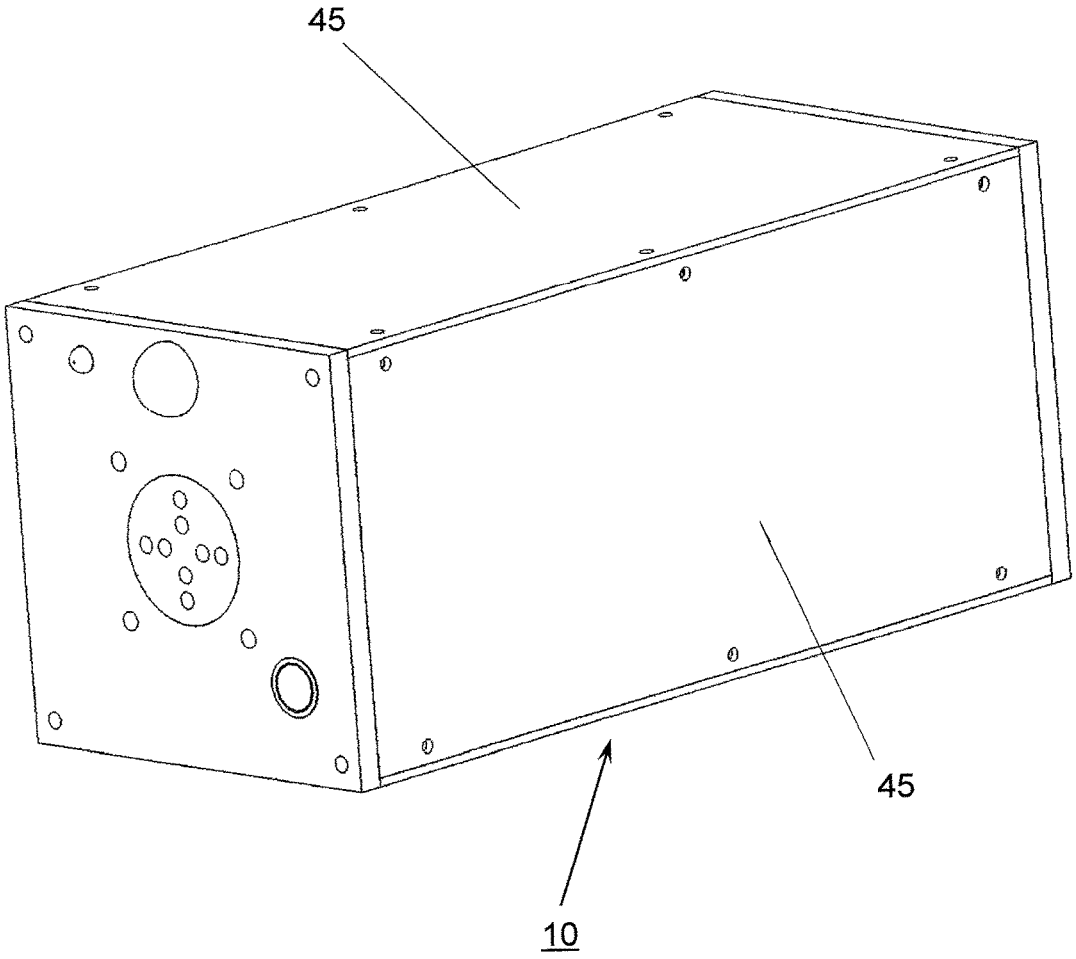
FIG. 16 is an overall front and side view with the outer casing of an embodiment of the fire suppression system of the present application.

FIGS. 1-13 and 16 illustrate an embodiment of the fire suppression system 10 of the present application. FIGS. 14 and 15 display an embodiment of the nozzle 15 of the present invention with nine agent ports 16 and nine port connectors 19. This embodiment describes a system specifically designed for the suppression of a fire or heat event. It is, however, anticipated by the applicants that the system may be adapted to other events or application where the direct and discreet application of a fluid or agent may be required.

Fire suppression system 10 comprises a nozzle block 15 that is configured with multiple agent ports 16 that are designed and fabricated at specific angles, cross sections, geometries, shapes and sizes specific to the location in which the system 10 is designed to be installed and the area to which the system 10 is intended to provide fire suppression. The nozzle block 15 of FIGS. 1-13 and 16 is comprised of eight agent ports 16 while the alternate nozzle block 15 of FIGS. 14 and 15 has nine agent ports. Nozzle block 15 has an outward nozzle face 17 which directly faces the area in which a fire event is to be suppressed and an inward nozzle face 18 on the opposite side of the block 15. In this embodiment the nozzle block 15 is designed to remain stationary during operation and is rigidly affixed in the system 10, but it is foreseeable applications where the nozzle block 15 may be moveable or rotatable. The agent ports 16 extend from the outward face 17 to the inward face 18 through the block 15. Port connectors 19 are affixed to the agent ports 16 on the inward face 18.

The system 10 further comprises a port switching assembly 49 comprising a manifold 50, multiple solenoids 60 and multiple agent cells 80. In this embodiment each solenoid 60 is attached to a separate agent cell 80 which contains a fire suppressive media. Here, the eight solenoids 60 are matched with eight agent cells 80. In other embodiments there may be one large cell or supply of agent connected to all of the solenoids rather than one per each solenoid and port if desired. Each solenoid 60 is fluidly connected to a cell 80 located next to it through ducts machined in the manifold 50. Each solenoid 60 also has an electrical input 62 allowing electrical and electronic connection and control. Each cell 80 has an outlet 82 which is connected to an individual port connector 19 by a fluid line or tube (not depicted). Pressurized air or other gas is introduced into the assembly 49 through a pressure inlet 52 configured into the manifold 50. The introduced pressure is directed to the solenoids 60 through vents in the manifold 50. As a result, there is a fluid connection from a pressurized source of air or gas to a group of solenoids 60, to a group of agent cells 80, then to port connectors 19 and finally to agent ports 16 with each solenoid 60 being individually attached to a specific cell 80, connector 19 and port 16. Alternatively, the pressurized source may be connected to a central supply of agent thereby pressurizing it. Such pressurized agent would then be released through individual valves and ports as required. Individual connections allow the ports 16 to be operated independently of, or in conjunction with, each other.

The nozzle block 15 is affixed to a front plate 20 which is itself attached to frame 40 in which the port switching assembly 49 and other components of the system 10 are positioned. A rear plate 30 is located at the opposite end of the frame 40 in relation to the front plate 20. A casing 45 may be found around the frame 40. The size of the system 10 and its position in a specific location is based upon the intended use.

Affixed in the front plate 20 are the nozzle block 15, an infrared (IR) sensor 24, an ultraviolet (UV) sensor 26 and a camera 28. Rear plate 30 is configured with a pressure connection 32, an electrical access 34 and an Ethernet hookup point 36. For better clarity of the components of the system 10, electrical wiring and electronic connections to the camera 28, sensors 24, 26, solenoids 60, Ethernet hookup 36, logic boards 100, external power source and optional computer controller are not shown.

Logic boards 100 are positioned within the frame 40 and contain the necessary circuitry, processors and controllers needed to operate the system 10. The boards 100 control, operate and coordinate the actions and processes of the camera 28, sensors 24, 26 and solenoids 60. In an envisioned embodiment, the smart nozzle fire suppression system has a duel wavelength fire detection capability that integrates a short wavelength optical detector unit with a long wavelength detection and location CCD array. The multi-wavelength detection technique prevents false positive fire detections, while the computer algorithm acquires the CCD array data to provide the system with an ability to accurately locate the center of the fire zone and thereby directly deliver the suppressant towards the fire zone. The miniaturized CPU control unit located within the smart nozzle fire suppression system is capable of capturing upwards of 40 images per second. Analysis of fire detection occurs only after the short wavelength optical detection system indicates a fire. The current fire detection algorithm takes a gray-scaled image, smooths it and binarizes it based on pixel intensity. Using more efficient algorithms, the centroid of the fire zone is found and directs suppressant delivery to that zone. In the event the short wavelength optical detector fails, due to damage, the CPU unit is designed to continuously analyze images for fire events.

Operation

In operation, the camera 28 and/or the sensors 24, 26 detect a fire or heat event in a specific spot in the area to be protected either optically or via the wavelength of the heat of the event. This information may then be compared to previously gathered images of the area in question under normal conditions. Comparisons are made by the installed software, and the position of the event is determined by the hardware components of the logic boards 100 or by an external controller. Using the positioning data, the software determines which ports 16 of the nozzle block 15 are appropriate to activate to most effectively extinguish the fire. Previous to this, the system would have been sized and positioned specifically for the space to be protected with the block 15 and ports 16 being specifically designed to precisely reach all areas of the space in question. The space size and shape as well as the position of the system 10 and the specifications of the block 15 and ports 16 would have been programmed into the software. The Ethernet hookup point 36 may allow remote controlling, software programming and updates and/or live viewing and saving of the camera 28 and sensor 24, 26 images.

After the software has determined which ports 16 will be needed to extinguish a fire the specific solenoids 60 assigned to those ports 16 will be opened. As the solenoids 60 are opened, pressurized air, or other gas, is released to the agent cells 80 connected to the solenoids 60 by passages in the manifold 50. The agent cells 80 contain the proper fire extinguishing agent for an anticipated event. When the compressed air (or other fluid) is released by the solenoids 60 to the cells 80 the agent in the cells is projected out of the cell 80 through the cell outlets 82 to the port connectors 19 and out of the ports 16 towards the fire event. The combination of the agent released from the ports 16 will form a single jet that will be applied directly on the fire. Neither the nozzle block 15 nor the system 10, itself, moves during this process. The choice of specific nozzles places the extinguishing jet exactly where needed. The sensors 24 and 26 will indicate when the fire is extinguished, pass this information to the controlling hardware and software and the solenoids 60 will be closed and the flow of the agent will be stopped. The cells 80 are accessible and may be detached from the manifold 50 for refilling or replacement.

This type of system 10 allows for a fire to be extinguished in an enclosed area using a minimal amount of fire suppression agent to a discreet and selective area. In this way, agent is only applied to an affected area, thereby protecting other non-affected components from the agent. Excessive amounts of agent will not be used as a result of the direct application and automated shut off after the event is extinguished. The system 10 may be sized and designed for many shapes and sizes of areas and positioned to reach specific locations in those areas.

It is anticipated that this system and device may be used in any case where fluid is desired to be applied to a specific spot while limiting fluid and energy wastage. Such applications may include, but are not limited to, fire suppression, cooling, paint application, pesticide application, watering, coating, de-icing, steaming and heating. The software and hardware may be adjusted to detect and apply a needed fluid for such divergent applications. The specific software, hardware, electronics and control elements for the control of the detecting and locating of an event as well as the selection of the proper port(s) and the release and shut of the fluid media are common to the art and can be based on a wide variety of computer languages and coding systems. Relevant detection equipment (cameras and sensors) may be employed to sense events and software may be written to perform the required operations. The above system is very versatile and may be adjusted to meet the requirements of a multitude of applications where direct fluid application is needed. Therefore, the scope of the structure should be determined by the appended claims and their legal equivalents, rather than by the examples presented.

What is claimed is:

1. A smart nozzle fluid delivery system comprising at least one sensor, wherein the at least one sensor is configured to directly detect and identify an event, a nozzle block wherein the block is comprised of multiple nozzle ports through each of which a jet of fluid media is selectively expelled, wherein a size, angle and shape of the multiple nozzle ports are individually configured in order that the fluid media is expelled through a combination of more than one of the multiple nozzle ports, wherein the jet of fluid media selectively expelled from the multiple nozzle ports interact to form a single directed jet of fluid media, each of the multiple nozzle ports having an individual valve, each of the multiple nozzle ports having an individual fluid media cell, the individual media cell containing the fluid media in order that the fluid media may be expelled under pressure through the multiple nozzle ports wherein the single directed jet of fluid media is projected onto the event; and a logic board electronically connected to the at least one sensor and the individual valves, wherein the logic board will receive a position of the event and direct the release of the fluid media through a combination of said individual valves to apply the directed jet of the fluid media to a selective and discreet area defined by the event.

2. The smart nozzle fluid delivery system of claim 1 wherein the at least one sensor is an optical sensor.

3. The smart nozzle fluid delivery system of claim 1 wherein the individual valves are solenoids.

4. The smart nozzle fluid delivery system of claim 1 wherein the nozzle block is stationary.

5. The smart nozzle fluid delivery system of claim 1 wherein the nozzle block is moveable.

6. The smart nozzle fluid delivery system of claim 1 wherein the fluid media is under pressure.

7. The smart nozzle fluid delivery system of claim 1 wherein the at least one sensor is an infrared sensor.

8. The smart nozzle fluid delivery system of claim 1 wherein the at least one sensor is an ultraviolet sensor.

9. The smart nozzle fluid delivery system of claim 1 further comprising a video camera configured to identify an event.

10. The smart nozzle fluid delivery system of claim 7 further comprising a second sensor wherein the second sensor is an ultraviolet sensor.

11. The smart nozzle fluid delivery system of claim 8 further comprising a second sensor wherein the second sensor is an infrared sensor.

12. The smart nozzle fluid delivery system of claim 9 further comprising a second sensor.

13. The smart nozzle fluid delivery system of claim 1 wherein the multiple nozzle ports comprise more than two nozzle ports.

* * * * *